US006910349B2

(12) United States Patent
Bodell, II et al.

(10) Patent No.: US 6,910,349 B2
(45) Date of Patent: Jun. 28, 2005

(54) SUCTION CONNECTION FOR DUAL CENTRIFUGAL COMPRESSOR REFRIGERATION SYSTEMS

(75) Inventors: Mark Robinson Bodell, II, York, PA (US); Dennis L. Deitz, Jr., Windsor, PA (US); Russell Mark Thompson, York, PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 10/633,844

(22) Filed: Aug. 4, 2003

(65) Prior Publication Data

US 2004/0031286 A1 Feb. 19, 2004

Related U.S. Application Data

(60) Provisional application No. 60/401,354, filed on Aug. 6, 2002.

(51) Int. Cl.[7] ..... F25B 39/02

(52) U.S. Cl. ..... 62/515; 62/478; 62/522

(58) Field of Search ..... 62/515, 527, 516, 62/522, 478

(56) References Cited

U.S. PATENT DOCUMENTS 3,280,582 A * 10/1966 Knaebel ..... 62/278
3,386,262 A * 6/1968 Hackbart et al. ..... 62/469
3,438,218 A 4/1969 O'Neil
3,644,054 A 2/1972 Pilarczyk
4,180,986 A 1/1980 Shaw
4,262,488 A 4/1981 Conine
4,460,319 A 7/1984 Ashikian
4,554,795 A 11/1985 Ibrahim
4,646,530 A 3/1987 Huenniger
4,653,286 A 3/1987 Huenniger
5,156,530 A 10/1992 Rutschle
5,362,203 A 11/1994 Brasz
5,404,730 A 4/1995 Westermeyer
5,520,507 A 5/1996 Haugen
5,536,141 A 7/1996 Haugen
5,605,435 A 2/1997 Haugen
5,611,664 A 3/1997 Haugen
5,787,728 A 8/1998 Das et al.
5,803,717 A * 9/1998 Iversen et al. ..... 417/312
6,027,315 A 2/2000 Hogan

* cited by examiner

*Primary Examiner*—Melvin Jones
(74) *Attorney, Agent, or Firm*—McNees Wallace & Nurick LLC; K. Scott O'Brian; Brian T. Sattizahn

(57) ABSTRACT

A dual centrifugal compressor refrigeration system has one evaporator for both compressors. The evaporator provides the centrifugal compressors with refrigerant vapor through separate suction connections for each compressor. Each suction connection has a protrusion that extends into the evaporator vessel to disturb the axial flow of refrigerant vapor in the evaporator vessel. The disturbance of the axial flow of refrigerant vapor in the evaporator vessel permits a surging compressor to draw refrigerant vapor in order to recover from the surge condition.

24 Claims, 6 Drawing Sheets

SUCTION CONNECTION FOR DUAL CENTRIFUGAL COMPRESSOR REFRIGERATION SYSTEMS

CROSS-REFERENCE TO RELATED APPLICATIONS

This application claims the benefit of U.S. Provisional Application No. 60/401,354 filed Aug. 6, 2002.

BACKGROUND OF THE INVENTION

The present invention relates generally to a suction connection for a compressor. Specifically, the present invention relates to a suction connection in the evaporator that increases the aerodynamic stability of multiple centrifugal compressors operating in parallel in a refrigeration system.

To obtain increased capacity in a refrigeration system, two centrifugal compressors can be connected in parallel to a common refrigerant circuit. Frequently, for capacity control, one of the compressors is designated as a "lead" compressor and the other compressor is designated as a "lag" compressor. The capacity of the refrigeration system, and of each compressor, can be controlled by the use of adjustable pre-rotation vanes or inlet guide vanes incorporated in or adjacent to the suction inlet of each compressor. Depending on the particular capacity requirements of the system, the pre-rotation vanes of each centrifugal compressor can be positioned to control the flow of refrigerant through the compressors and thereby control the capacity of the system. The positions of the pre-rotation vanes can range from a completely open position to a completely closed position. The pre-rotation vanes for a centrifugal compressor can be positioned in a more open position to increase the flow of refrigerant through the compressor and thereby increase the capacity of the system or the pre-rotation vanes of a centrifugal compressor can be positioned in a more closed position to decrease the flow of refrigerant through the compressor and thereby decrease the capacity of the system.

During operation, a compressor instability or surge condition can occur in a centrifugal compressor, wherein the compressor cannot pump the flow against its discharge pressure. Surge or surging is an unstable condition that may occur when compressors, such as centrifugal compressors, are operated at light loads and high pressure ratios. A high compressor pressure ratio, sometimes called lift or head, may be expressed in a number of fashions. A simplified representation of this compressor pressure ratio is (discharge pressure minus suction pressure (differential pressure or "$\Delta P$")) divided by suction pressure ("P"), or expressed symbolically, $(\Delta P)/P$. A lower suction pressure will increase the compressor ratio and decrease the stability of a centrifugal compressor. Surge is a transient phenomenon characterized by high frequency oscillations in pressures and flow, and, in some cases, the occurrence of a complete flow reversal through the compressor. Surging, if uncontrolled, can cause excessive vibrations in both the rotating and stationary components of the compressor, and may result in permanent compressor damage. During a surge condition there can exist a momentary reduction in flow and pressure developed across the compressor. Furthermore, there can be a reduction in the net torque and mechanical power at the compressor driving shaft. In the case where the drive device of the compressor is an electric motor, the oscillations in torque and power caused by a surge condition can result in oscillations in motor current and excessive electrical power consumption.

In dual compressor applications, the occurrence of a surge or lack of pumping condition on one compressor results in the other compressor having an increase in refrigerant flow. This increase in refrigerant flow to the non-surging compressor makes it more difficult for the surging compressor to recover from its instability. Axial gas flow within the evaporator to the stable compressor will pass over a suction opening of the unstable compressor, thereby lowering the pressure at the unstable compressor suction connection which further contributes to instability. Several different techniques have been used to limit the potential aerodynamic impact one compressor may have upon the other compressor in a dual compressor system. Some chiller systems with two compressors utilize two completely separate refrigerant circuits to avoid the problem of one compressor aerodynamically impacting the other compressor. Other dual compressor chiller systems which use a common refrigerant circuit have a baffle in the gas plenum space of the evaporator between the suction connections of the compressors to reduce the aerodynamic impact of one compressor upon the other compressor. In this type of system each of the two suction connections are typically located approximately one quarter of the evaporator shell's length from the ends of the evaporator shell, because of the baffle or partition bisecting the evaporator shell into substantially equal halves. Both of these solutions have several drawbacks including a more complicated and expensive implementation of the evaporator. A completely separated evaporator shell would result in less heat exchanger surface being available during single compressor operation, and therefore would provide less effective heat transfer and reduced performance. Flooded shell and tube evaporators boil refrigerant liquid on the shell side to cool water flowing through the tubes. The refrigerant gas flow evaporating off the liquid surrounding the tubes will carry some of the liquid along with the gas. Evaporator heat exchangers typically use baffle passages or mesh pad eliminators to remove the liquid droplets from the gas before entering the compressor suction. If the vapor space above the baffle or mesh pad is separated into halves, as in some systems, the boiling activity in single compressor operation is concentrated in one half of the evaporator using one half of the mesh pads. This provides less effective vapor separation than if the entire baffle or mesh pad section were utilized.

Therefore, what is needed is a simple and economical suction connection for use in a dual compressor refrigeration system that can increase pressure at the suction connection to encourage the flow of refrigerant vapor into a surging compressor to thereby enhance the ability of the surging compressor to recover from its instability.

SUMMARY OF THE INVENTION

One embodiment of the present invention is directed to a suction connection for a compressor of a refrigeration system. The suction connection is in fluid communication with an evaporator of the refrigeration system. The suction connection includes a protrusion extending into the evaporator upon installation of the suction connection. The protrusion is configured and disposed to disturb axial flow of refrigerant vapor in the evaporator. This disturbance or disruption of the axial flow of refrigerant vapor in the evaporator can provide a flow of refrigerant to a surging compressor in a dual compressor system to permit the surging compressor to recover from its instability.

An alternate embodiment of the present invention is directed to a suction connection for a plurality of compressors of a refrigeration system in fluid communication with an evaporator of the refrigeration system. The suction connection includes at least one protrusion extending into the evaporator upon installation of the suction connection. The at least one protrusion is configured and disposed to disturb axial flow of refrigerant vapor in the evaporator.

A further alternate embodiment of the present invention is directed to a multiple compressor refrigeration system including two or more compressors, a condenser in fluid communication with the two or more compressors; an evaporator in fluid communication with the condenser, and a suction connection connecting the evaporator and the two or more compressors. The suction connection has at least one protrusion extending into the evaporator. The evaporator is configured to develop axial flow of refrigerant vapor adjacent to the suction connection and the at least one protrusion is configured and disposed to disturb the axial flow of refrigerant vapor in the evaporator.

One advantage of the present invention is that it encourages refrigerant vapor to flow into the suction connection of a surging compressor in a dual compressor system.

Another advantage of the present invention is that it can provide a more equal distribution and improved liquid/vapor separation with the evaporator heat exchanger.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
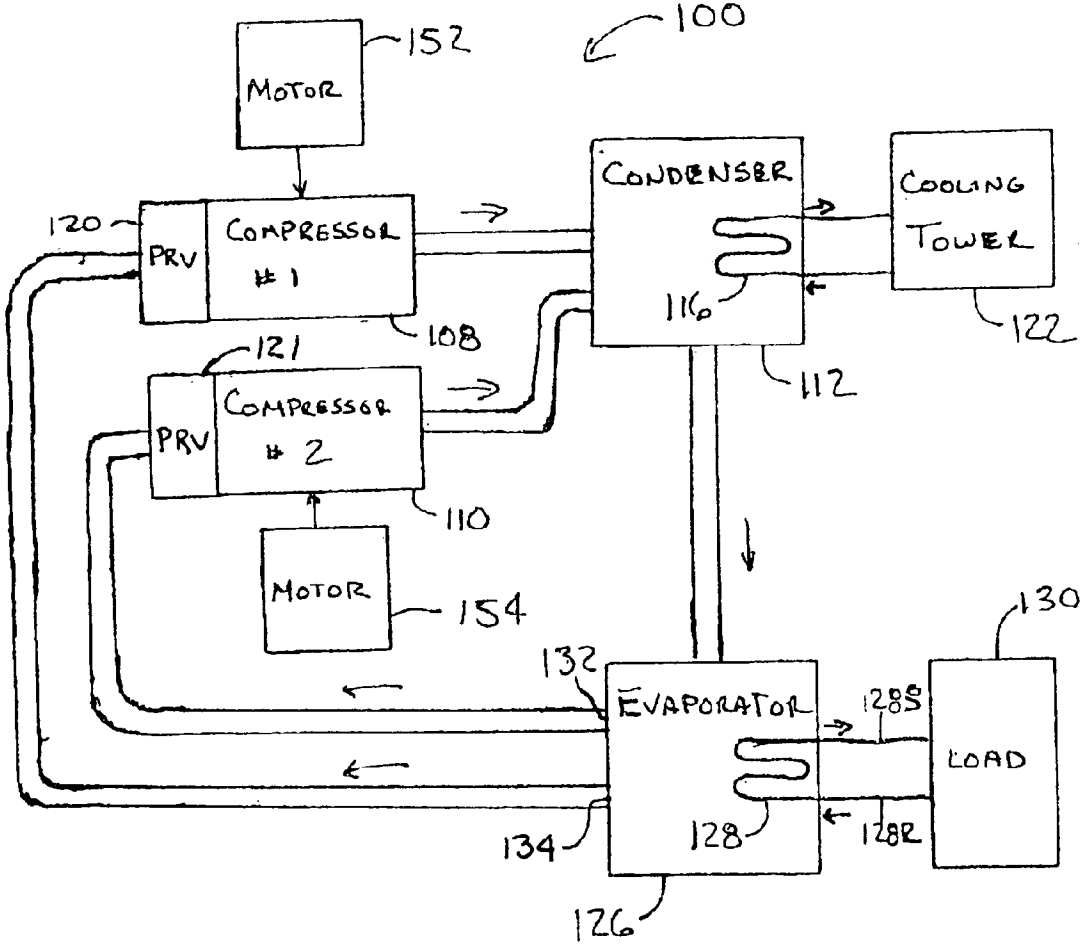
FIG. 1 illustrates schematically a refrigeration system of the present invention.

A general dual compressor system to which the invention can be applied is illustrated, by means of example, in FIG. 1. As shown, the HVAC, refrigeration or liquid chiller system 100 includes a first compressor 108, a second compressor 110, a condenser 112, a water chiller or evaporator 126, and a control panel (not shown). In another embodiment of the present invention, the liquid chiller system 100 could use one compressor or three or more compressors connected in parallel similar to the connection of the first and second compressors 108, 110. The control panel receives input signals from the system 100 that indicate the performance of the system 100 and transmits signals to components of the system 100 to control the operation of the system 100. The conventional liquid chiller system 100 includes many other features which are not shown in FIG. 1. These features have been purposely omitted to simplify the drawing for ease of illustration.

The compressors 108 and 110 compress a refrigerant vapor and deliver it to the condenser 112 by separate discharge lines. In another embodiment of the present invention, the discharge lines from the compressors 108 and 110 can be combined into a single line that delivers refrigerant vapor to the condenser 112. The compressors 108 and 110 are preferably centrifugal compressors, however the present invention can be used with any type of compressor suitable for use in a chiller system 100. The refrigerant vapor delivered to the condenser 112 enters into a heat exchange relationship with a fluid, preferably water, flowing through a heat-exchanger coil 116 connected to a cooling tower 122. The refrigerant vapor in the condenser 112 undergoes a phase change to a refrigerant liquid as a result of the heat exchange relationship with the liquid in the heat-exchanger coil 116. The condensed liquid refrigerant from condenser 112 flows to an evaporator 126.

Figure 2:
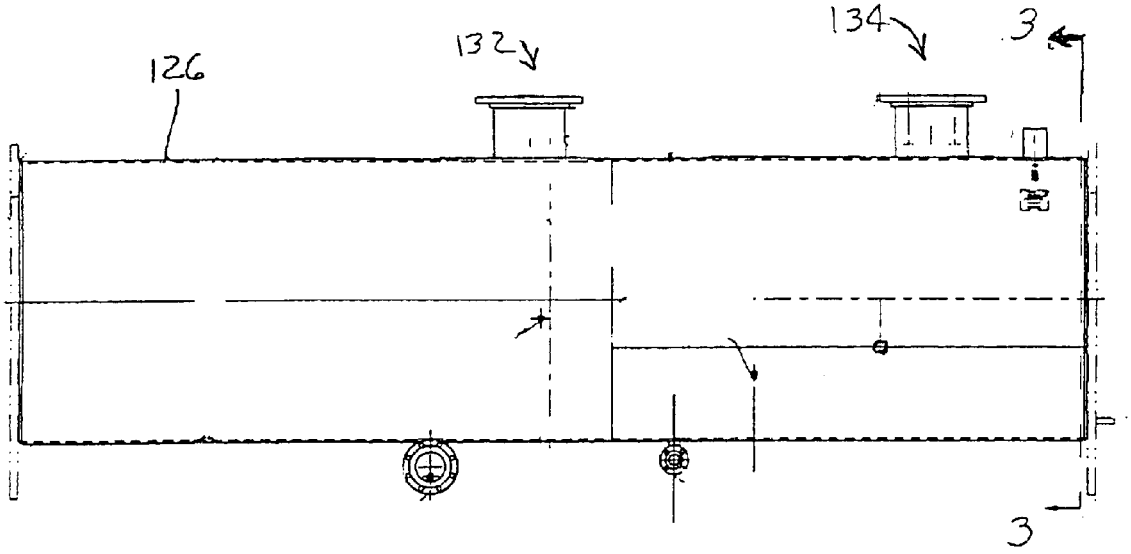
FIG. 2 illustrates an evaporator of the refrigeration system of the present invention.

The evaporator 126 can include a heat-exchanger coil 128 having a supply line 128S and a return line 128R connected to a cooling load 130. The heat-exchanger coil 128 can include a plurality of tube bundles within the evaporator 126. Water or any other suitable secondary refrigerant, e.g., ethylene, calcium chloride brine or sodium chloride brine, travels into the evaporator 126 via return line 128R and exits the evaporator 126 via supply line 128S. The liquid refrigerant in the evaporator 126 enters into a heat exchange relationship with the water in the heat-exchanger coil 128 to chill the temperature of the water in the heat-exchanger coil 128. The refrigerant liquid in the evaporator 126 undergoes a phase change to a refrigerant vapor as a result of the heat exchange relationship with the liquid in the heat-exchanger coil 128. The vapor refrigerant in the evaporator 126 exits the evaporator 126 through suction connections 132 and 134 as shown in FIG. 2 and returns to the compressors 108 and 110 by separate suction lines to complete the cycle.

At the input or inlets to the compressors 108 and 110 from the evaporator 126, there are one or more pre-rotation vanes or inlet guide vanes 120 and 121 that control the flow of refrigerant to the compressors 108 and 110. Actuators are used to open the pre-rotation vanes 120 and 121 to increase the amount of refrigerant to the compressors 108 and 110 and thereby increase the cooling capacity of the system 100. Similarly, the actuators are used to close the pre-rotation vanes 120 and 121 to decrease the amount of refrigerant to the compressors 108 and 110 and thereby decrease the cooling capacity of the system 100.

To drive the compressors 108 and 110, the system 100 includes a motor or drive mechanism 152 for the first compressor and a motor or drive mechanism 154 for the second compressor 110. While the term "motor" is used with respect to the drive mechanism for the compressors 108 and 110, it is to be understood that the term "motor" is not limited to a motor but is intended to encompass any component(s) that can be used in conjunction with the driving of the compressors 108 and 110, such as a variable speed drive and/or a motor starter in addition to the motor. In a preferred embodiment of the present invention, the motors or drive mechanisms 152 and 154 are electric motors and associated components. However, other drive mechanisms such as steam or gas turbines or engines and associated components can be used to drive the compressors 108 and 110.

In previous evaporators, the gas flowing from a refrigeration evaporator into a compressor suction connection typically leaves through a pipe opening contoured closely to the outside cylindrical shell wrapper of the evaporator vessel. When operating two or more compressors in parallel that draw refrigerant gas or vapor from one evaporator with the previous suction connection, a lack of pumping or "surge" condition can be observed in response to certain suction flow conditions. As one compressor enters a surge condition or state, the other compressor(s) have a stronger axial pull or draw of the gas through the evaporator gas passage. The evaporator gas passage is a section located above a liquid separation means, typically a mesh eliminator or a suction baffle passage. As this axial flow of the gas passes over the suction opening of the surging compressor it can create a lower relative dynamic suction pressure at the opening, making it more difficult for the surging compressor to recover and begin pumping gas again.

Figure 4:
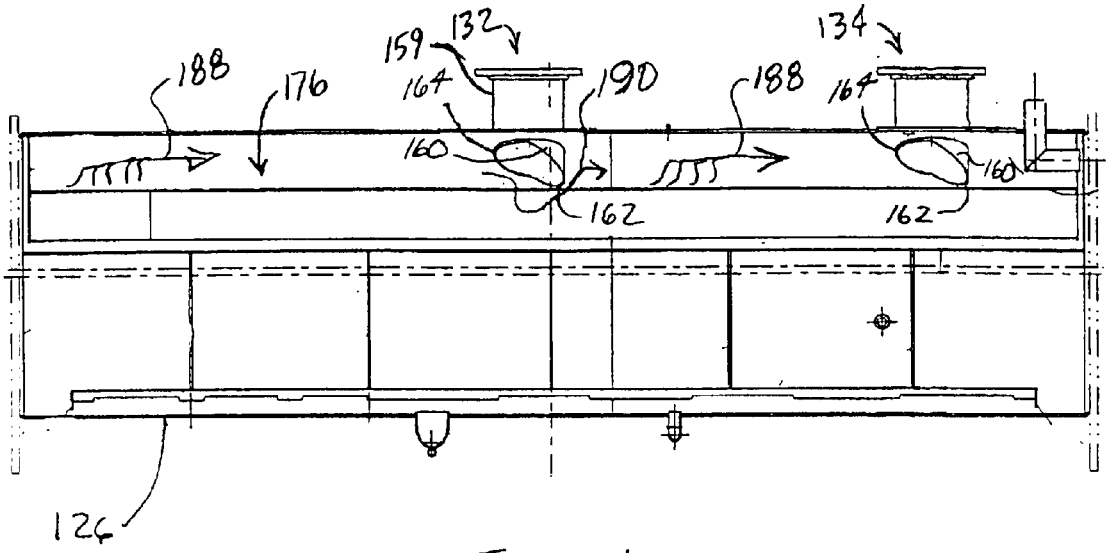
FIG. 4 illustrates a cross-sectional side view of the evaporator of the refrigeration system of the present invention taken along line 4—4 of FIG. 3, and additionally illustrates internally protruding features of the suction connections.
Figure 3:
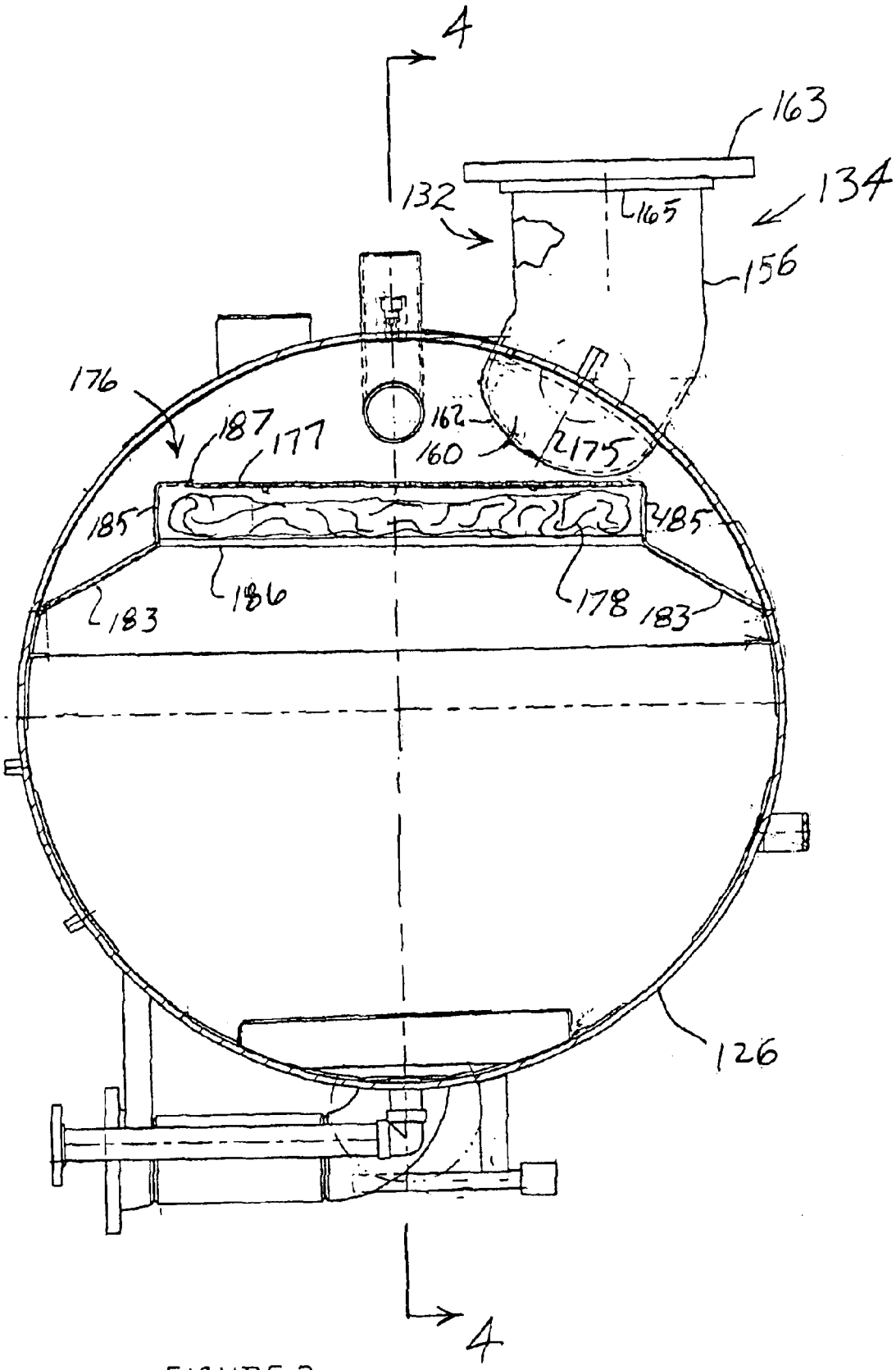
FIG. 3 illustrates an end view of the evaporator of the refrigeration system of the present invention taken along line 3—3 of FIG. 2.
Figure 5:
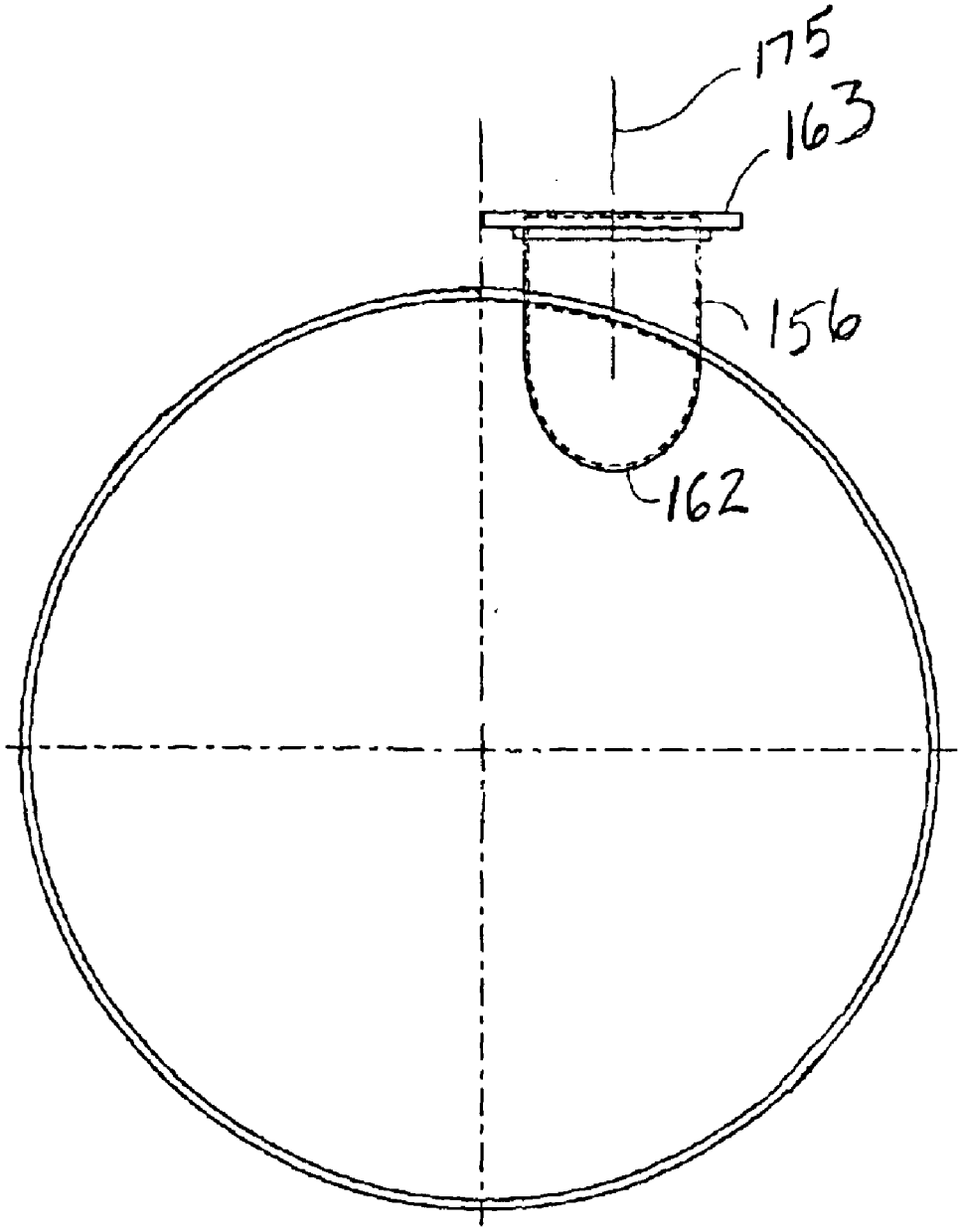
FIG. 5 illustrates a cross-sectional side view of the evaporator of the refrigeration system of the present invention taken along line 4—4 of FIG. 3, and additionally illustrates an alternate embodiment of the suction connections.

In contrast, the present invention has modified suction connections 132, 134, as shown in FIGS. 3–5, to achieve a more stabilized flow of refrigerant vapor to the compressors 108, 110. In a preferred embodiment of the present invention, suction connections 132, 134 can include an insert portion or member 156. Providing a convenient connection of suction connections 132, 134 with the compressors 108, 110, an end 165 of the insert member 156 may be connected to an annular flange 163, although other fastening arrangements as known in the art, such as clamping or bonding, may be employed. The insert member 156 is preferably formed from a single, straight continuous piece of material (FIG. 5). However, the insert member 156 can also be formed from one or more separate pieces securely connected, fastened or joined together, or a single, curved continuous piece of material (FIG. 3), if required, to connect with the compressors 108, 110.

Insert member 156 includes a tongue or protruding portion 160 that extends into and is positioned inside the evaporator shell 126 as shown in FIGS. 3–5. The protruding portion 160 preferably has the same profile, preferably cylindrical, as insert member 156, i.e., the protruding portion 160 is a direct extension of the insert member 156. However, in other embodiments of the present invention, the protruding portion 160 can have a profile different from the profile of insert member 156. In other words, one or more portions or segments of the protruding portion 160 can be disposed outside of the extended profile of insert member 156. For example, the protruding portion 160 can be disposed at an angle with respect to a portion of the insert member 156 (FIG. 3) or the protruding portion 160 and the insert member 156 can extend substantially axially within the evaporator 126. As shown in FIGS. 3 and 5, which are embodiments of the present invention, the center axis 175 of the protruding portion 160 can, but does not necessarily, extend toward the center of the evaporator 126, and may, in fact, extend away from the center of the evaporator 126. In addition, and in another embodiment of the present invention, the protruding portion 160 can include one or more apertures disposed within the protruding portion 160 and/or one or more slots disposed along the edge of the protruding portion 160 to permit partial flow of refrigerant vapor or gas through the protruding portion.

Figure 6:
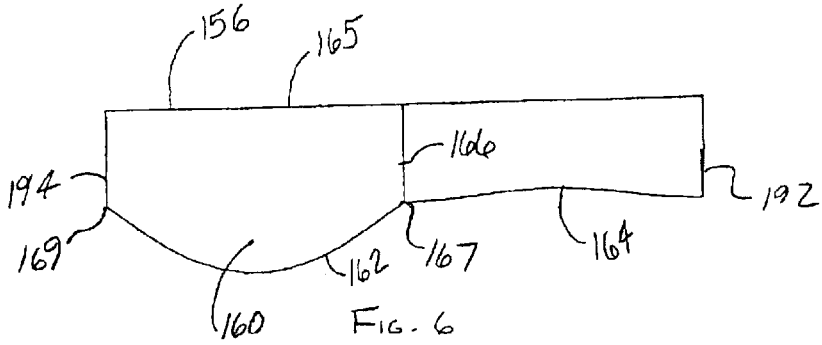
FIGS. 6–12 illustrate different views of the suction connection of the present invention.
Figure 8:
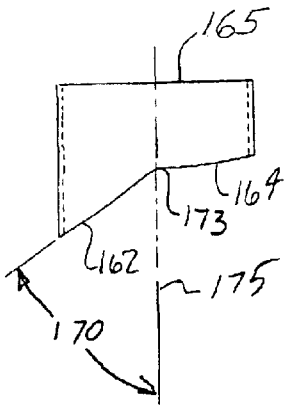
Figure 9:
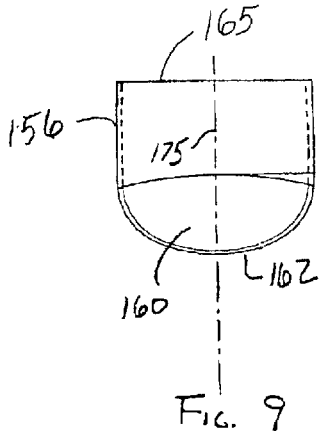
Figure 10:
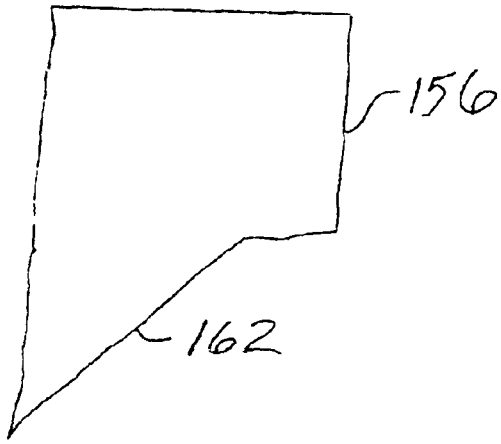
Figure 11:
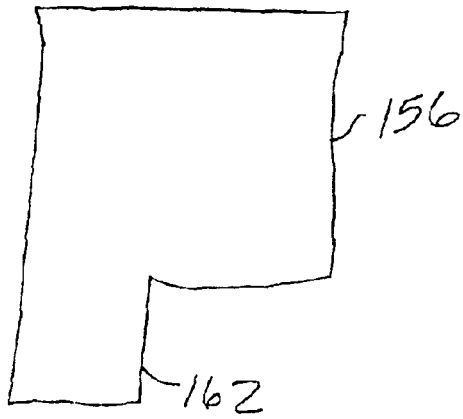
Figure 12:
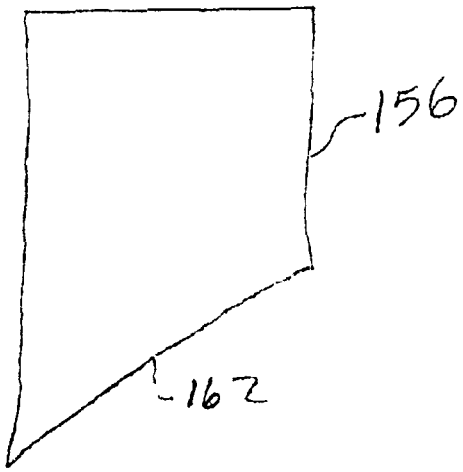

Referring to FIGS. 6–9, namely FIG. 6 which is a flat pattern of an embodiment of insert member 156, protruding portion 160 has a peripheral edge 162 that does not span the entire peripheral edge of insert member 156, terminating at bisecting line 166. The peripheral edge 162 extends from reference point 169, which defines the lower bound of end 194 of insert member 156, to reference point 167, that similarly defines the lower bound of bisecting line 166. While the peripheral edge 162 shown in FIG. 6 is substantially in the shape of an arc, it is to be understood that peripheral edge 162 can have any suitable shape including a shape having one or more linear segments or a shape having a wavy pattern. The bisecting line 166 is substantially equidistant between opposed ends 192 to 194 of insert member 156. In other embodiments of the present invention, such as shown in FIGS. 10–12, bisecting line 166 and reference point 167 can be positioned closer to either end 192 or end 194 to form a respectively larger or smaller protruding portion 160.

To form insert member 156 as used in the embodiment of the present invention shown in FIG. 6, ends 192, 194 are brought into physical contact with each other and bonded together, forming a cylindrical profile having the center axis 175. In the assembled embodiment of FIG. 6, any line passing through bisecting line 166 and end 194 that is also perpendicular to both bisecting line 166 and end 194 defines a diameter of insert member 156. Likewise, the line connecting reference points 167 and 169 defines a diameter of insert member 156 which is a reference axis 173. In another embodiment of the present invention, the inset member 156 can be formed of a single, continuous piece that has a profile or shape similar to the assembled shape of the insert member 156 shown in FIG. 6.

Referring to FIG. 8, protruding portion 160 is bound along its lower end, i.e., the end that is disposed or extended into the evaporator 126, by peripheral edge 162. The peripheral edge 162 preferably has one or more or points that correspond to the furthest extension, preferably along center axis 175, of the peripheral edge 162 into the evaporator 126. In a preferred embodiment of the present invention, the furthest extension points of the peripheral edge 162 preferably extend between about 6–11 inches into the evaporator 126. This extension of the peripheral edge 162 into the evaporator 126 proportionally corresponds from about 15 percent to about 25 percent of the outer perimeter of the protruding portion 160. A proportion of the peripheral surface of the protruding portion 160 extending into the evaporator 126 is between about one-fifteenth to about two-thirds of the outer perimeter of the insert member 156. Alternately, an extension of about one-half the outer perimeter of insert member 156 (FIG. 11) may be preferable. However, it is to be understood that any suitable extension depth for the peripheral edge 162 and proportion of the peripheral surface of protruding portion 160 can be used depending on the size and configuration of the evaporator 126, provided that the protruding portion 160 can disturb, but not block, the axial flow of refrigerant gas or vapor in the evaporator 126 and that if more than one insert member 156 is employed, the peripheral edge 162 and the protruding portion 160 may be, but are not necessarily, substantially identical.

Figure 7:
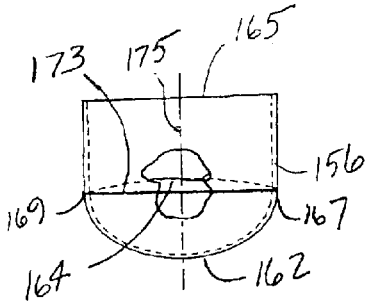

Alternatively, an insert angle 170 as shown in FIG. 8 can be defined as the angle between the center axis 175 and a plane that passes through reference axis 173 and the furthest extension point(s) of peripheral edge 162. Points 167 and 169 of reference axis 173 are coincident with the periphery of evaporator shell 126. In a preferred embodiment, the insert angle 170 measures about 35°, but may vary substantially either above or below this measured value, due to variations in operating parameters including, but not limited to, the type of refrigerant employed, evaporator shell dimensions, spacing between components within the evaporator, and vapor refrigerant flow rate. It is to be understood that different configurations of the protruding portion 160 and peripheral edge 162 may require slightly different techniques for measuring the insert angle 170. The protruding portion 160 also has a peripheral edge 164, which is opposite the peripheral edge 162. Peripheral edge 164 is formed to be substantially coincident to the periphery of the evaporator shell 126 upon assembly. As shown in FIGS. 7–9, protruding portion 160 as bound by peripheral edge 162 resembles a tongue, the profile, namely the "tip" of the tongue, becoming increasingly pronounced as the insert angle 170 is increased.

Referring to FIGS. 3–4, suction connections 132, 134 have a substantially similar radial position with respect to the center axis of the evaporator shell 126. Suction connection 132 is positioned at approximately the mid span of the axial length of the evaporator shell 126, while suction connection 134 is positioned adjacent one end of the evaporator shell 126. This spacing arrangement permits effective use of the entire length of the evaporator shell 126 for drawing vapor refrigerant into suction connections 132, 134. For purposes of orientation, suction connection or connector 134 is preferably positioned opposite the direction of axial refrigerant vapor flow 188 created by the phase change of refrigerant liquid resulting from the heat exchange with the liquid in the heat-exchanger coil 128 (FIG. 1) as previously discussed. That is, at least a portion of the refrigerant vapor axial flow stream 188 will travel almost the entire length of the evaporator shell 126 prior to reaching suction connector 134. The protruding portions 160 of respective suction connections or connectors 132, 134 are oriented to open into and substantially fully face the direction of refrigerant vapor axial flow 188 that is discussed in greater detail below. In other words, the refrigerant vapor axial flow stream 188 emanating adjacent the end opposite suction connector 134 is first directed past peripheral edge 164 of insert member 156 of suction connector 132 prior to encountering the protruding portion 160. This encounter with protruding portion 160 disturbs the flow stream 188 of refrigerant vapor passing along suction connector 132 and generates turbulence 190 in the flow stream 188. The turbulence 190 joined by additional refrigerant vapor axial flow 188 likewise encounters the protruding portion 160 of suction connector 134, producing similar turbulence in the flow. These combined disturbances in vapor refrigerant suction flow enhances the stability of the two compressors 108, 110 by disturbing the laminar flow of refrigerant vapor and generating turbulence, which, in turn, enables flow into the suction connection of the weaker or surging compressor, which typically would be compressor 110 that receives refrigerant from suction connector 132. In a preferred embodiment as shown in FIG. 4, both suction connections 132, 134 have a protruding portion 160. However, both suction connections 132, 134 do not require a protruding portion 160. If only one suction connection 132, 134 has a protruding portion 160, it is preferably suction connection 132, although it could be suction connection 134. In addition, protruding portion 160 can be incorporated into the suction connection for a compressor in a single compressor refrigeration system.

To provide effective vapor refrigerant flow over substantially the entire length of the evaporator shell 126, a cap plate 176 is provided that spans substantially the entire length of the evaporator shell 126. The cap plate 176 includes opposed sloped portions 183 that are each secured to the inside wall of the evaporator shell 126. Each sloped portion 183 extends to opposed vertical portions 185 that are spanned by a cap portion 187. The cap portion 187 has a plurality of apertures 177 formed therethrough along substantially the entire length of the cap portion 187 to permit the flow of vapor refrigerant 188 through the apertures 177 of the cap plate 176 and the suction connectors 132, 134 of the evaporator shell 126 in response to the suction from suction connectors 132, 134. By forming the apertures 177 in a substantially uniform pattern over the entire length of the cap portion 187, a small pressure drop is generated, which is nonetheless more than the axial pressure drop in the evaporator. This ensures uniform loading of the evaporator tube bundle along its length and minimizes liquid droplets mixing with the vapor. Further, an optional filtering means, such as a mesh pad 178 or baffle is secured within the recess formed by the collective vertical portions 185 and cap plate 176. Securing the mesh pad 178 in this position is a plurality of support members 186 which span along the lower portion of vertical portions 185. Mesh pad 178 is composed of a material that permits vapor refrigerant to flow therethrough while obstructing droplets striking the mesh pad 178 to prevent their entry into the suction connections 132, 134.

One having ordinary skill in the art will appreciate that both the shape of protruding portions 160 and the location of suction connectors 132, 134 may vary significantly from the positions described in the preferred embodiment. That is, protruding portions 160 employed in suction connectors 132, 134 may differ in both profile and size, not being constrained to the cylindrical walls of insert member 156, such as forming a flat or even a curved plate as long as the protruding portion 160 is secured substantially full face in the stream of suction vapor refrigerant to disrupt the axial flow of vapor refrigerant over the suction connections 132, 134 and provide improved stability of the compressors 108, 110 against surging. Protruding portion 160 may be an insert, may be a contoured or cut shape in the end of the suction pipe connections 132, 134 themselves, or may be an elbow. Finally, the protruding portions 160 can be used in conjunction with other known surge control techniques and procedures.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A suction connection for connecting a compressor and an evaporator in a refrigeration system, the suction connection comprising a protrusion extending into the evaporator upon installation of the suction connection, the protrusion being configured and disposed to disturb axial flow of refrigerant vapor in the evaporator.

2. The suction connection of claim 1 wherein the protrusion is configured and disposed to substantially face the axial flow of refrigerant vapor in the evaporator.

3. The suction connection of claim 1 wherein the protrusion has a peripheral edge formed of an arc.

4. The suction connection of claim 1 wherein the protrusion has a peripheral edge formed of at least one linear segment.

5. The suction connection of claim 1 wherein the protrusion comprises at least one aperture.

6. The suction connection of claim 1 wherein the protrusion comprises at least one slot.

7. The suction connection of claim 1 further comprises a pipe having an outer perimeter, the pipe being configured and disposed to connect the compressor and the evaporator, and wherein the protrusion is a continuous portion of the pipe extending into the evaporator.

8. The suction connection of claim 7 wherein the continuous portion of the pipe extending into the evaporator is disposed on between about one-fifteenth to about two-thirds of the outer perimeter of the pipe.

9. The suction connection of claim 7 wherein the continuous portion of the pipe extending into the evaporator is disposed on about one-half of the outer perimeter of the pipe.

10. The suction connection of claim 7 wherein the pipe comprises a second portion disposed opposite the protrusion, the second portion of the pipe being substantially coincident with the evaporator.

11. The suction connection of claim 10 wherein the protrusion is configured and disposed to substantially face the axial flow of refrigerant vapor in the evaporator, the axial flow of refrigerant vapor flowing by the second portion of the pipe and an opening in the pipe prior to encountering the protrusion.

12. A suction connection for a plurality of compressors of a refrigeration system in fluid communication with an evaporator of the refrigeration system, the suction connection comprising at least one protrusion extending into the evaporator upon installation of the suction connection, the at least one protrusion being configured and disposed to disturb axial flow of refrigerant vapor in the evaporator.

13. The suction connection of claim 12 further comprises:

a first pipe being configured and disposed to connect the evaporator to a first compressor of the plurality of compressors and a second pipe being configured and disposed to connect the evaporator to a second compressor of the plurality of compressors; and the at least one protrusion being disposed on at least one of the first pipe and the second pipe.

14. The suction connection of claim 13 wherein the at least one protrusion comprises a first protrusion being disposed on the first pipe and a second protrusion being disposed on the second pipe, the first protrusion and the second protrusion having a substantially similar profile.

15. The suction connection of claim 14 wherein the first protrusion and the second protrusion are substantially radially aligned within the evaporator.

16. The suction connection of claim 14 wherein the first protrusion and the second protrusion are disposed to substantially face the axial flow of refrigerant vapor in the evaporator.

17. The suction connection of claim 14 wherein the first protrusion and the second protrusion each have a peripheral edge formed of an arc.

18. The suction connection of claim 14 wherein the first protrusion comprises a continuous portion of the first pipe extending into the evaporator and the second protrusion comprises a continuous portion of the second pipe extending into the evaporator.

19. The suction connection of claim 18 wherein the first pipe and the second pipe each have an outer perimeter, and wherein the continuous portion of the first pipe is disposed on between about one-fifteenth to about two-thirds of the outer perimeter of the first pipe and the continuous portion of the second pipe is disposed on between about one-fifteenth to about two-thirds of the outer perimeter of the second pipe.

20. The suction connection of claim 19 wherein the continuous portion of the first pipe is disposed on about one-half of the outer perimeter of the first pipe and the continuous portion the second pipe is disposed on about one-half of the outer perimeter of the second pipe.

21. The suction connection of claim 14 wherein the first protrusion is positioned adjacent the midspan of the evaporator, the second protrusion is positioned adjacent one end of the evaporator.

22. The suction connection of claim 21 wherein the second protrusion is positioned adjacent an end of the evaporator that is opposite a direction of axial flow of refrigerant vapor in the evaporator.

23. A multiple compressor refrigeration system comprising:

two or more compressors;

a condenser in fluid communication with the two or more compressors;

an evaporator in fluid communication with the condenser;

a suction connection connecting the evaporator and the two or more compressors, the suction connection comprising at least one protrusion extending into the evaporator; and wherein the evaporator is configured to develop axial flow of refrigerant vapor adjacent to the suction connection and the at least one protrusion being configured and disposed to disturb the axial flow of refrigerant vapor in the evaporator.

24. The multiple compressor refrigeration system of claim 23 wherein a length of the at least one protrusion is between about 15 percent to about 25 percent of an outer perimeter of the suction connection.

* * * * *